US009897327B2

(12) United States Patent
Phillips et al.

(10) Patent No.: US 9,897,327 B2
(45) Date of Patent: Feb. 20, 2018

(54) ANTI-SPILL OVEN DOOR VENTS

(71) Applicant: Electrolux Home Products, Inc., Charlotte, NC (US)

(72) Inventors: Bryan Thomas Phillips, Goodletsville, TN (US); Brian Martin, Springfield, TN (US); Tommaso Raggi, Nashville, TN (US); Gabriele Gardini, Cervia (IT)

(73) Assignee: Electrolux Home Products, Inc., Charlotte, NC (US)

( * ) Notice: Subject to any disclaimer, the term of this patent is extended or adjusted under 35 U.S.C. 154(b) by 768 days.

(21) Appl. No.: 14/328,819

(22) Filed: Jul. 11, 2014

(65) Prior Publication Data

US 2016/0010874 A1 Jan. 14, 2016

(51) Int. Cl.

| | |
|---|---|
| ***F24C 15/00*** | (2006.01) |
| ***F24C 15/02*** | (2006.01) |
| ***F24C 15/04*** | (2006.01) |

(52) U.S. Cl.

CPC ..... *F24C 15/006* (2013.01); *F24C 15/021* (2013.01); *F24C 15/028* (2013.01); *F24C 15/04* (2013.01)

(58) Field of Classification Search

CPC . F24C 15/025; F24C 15/006; F16F 2236/103; F16F 2238/026

USPC ..... 126/198, 193

See application file for complete search history.

(56) References Cited

U.S. PATENT DOCUMENTS

| | | | | |
|---|---|---|---|---|
| 3,659,578 | A | 5/1972 | Davis et al. | |
| 3,859,499 | A | 1/1975 | Evans et al. | |
| 7,847,219 | B2 * | 12/2010 | Kim | F24C 15/006 126/198 |
| 8,028,619 | B2 | 10/2011 | Lee et al. | |
| 2008/0105140 | A1 * | 5/2008 | Lee | F24C 15/006 99/468 |

FOREIGN PATENT DOCUMENTS

| | | | |
|---|---|---|---|
| DE | 102008033536 | A1 | 1/2010 |
| DE | 102010063847 | A1 | 6/2012 |
| EP | 1801505 | A2 | 6/2007 |
| KR | 20060104751 | A | 10/2006 |
| WO | 2008051051 | A1 | 5/2008 |

OTHER PUBLICATIONS

International Search Report and Written Opinion in parent PCT/US2015/039920, dated Nov. 20, 2015.

* cited by examiner

*Primary Examiner* — Avinash Savani
*Assistant Examiner* — Aaron Heyamoto
(74) *Attorney, Agent, or Firm* — Pearne & Gordon LLP

(57) ABSTRACT

A cooking apparatus comprises a housing forming an oven cavity within the housing. A door is attached to the housing for selectively opening and closing the oven cavity. The door comprises an outer surface and an inner surface. The inner surface includes a vent in fluid communication with an air channel within the door. A movable blocking element for selectively opens and closes the vent. The movable blocking element is biased against the vent when the door is open, thereby closing the vent when the door is open. The movable blocking element is configured to translate linearly within the door, toward the vent and away from the outer surface of the door to close the vent, and toward the outer surface of the door and away from the vent to open the vent.

18 Claims, 5 Drawing Sheets

ANTI-SPILL OVEN DOOR VENTS

BACKGROUND OF THE DISCLOSURE

Field of the Disclosure

The present disclosure relates to cooking appliances, and, more particularly, to an oven door having an anti-spill vent.

Description of Related Art

Ovens, such as a wall oven or freestanding range, have a hinged oven door that provides access to the oven or cooking cavity. The inner surface of the oven door can have vents, and the vents can allow airflow through the oven door to cool the outer surface of the door when the oven is operating. The vents in the oven door may align with vents on the oven housing when the oven door is closed. Such a configuration can allow air to be drawn into the oven door through additional vents along a lower edge of the door. Air drawn into the door can flow between panes of window glass in the oven door to cool the glass. The air drawn into the oven door flows through the vents in the inner surface of the oven door and through the aligned vents on the oven housing. The air can then flow through channels within the oven housing and be discharged from the oven housing.

A problem associated with vents in the inner surface of an oven door is that solid food or liquids can enter the interior of the oven door through the vents. For example, liquids can be accidentally spilled into the vents when the door is open. Such liquids may stain the window glass of the oven door and/or cause unpleasant odors during cooking. It can be difficult to clean such liquids from the interior of the oven door, which may require disassembling the door. Thus, it would be desirable close the vents on the inner surface of the oven door when the door is open.

BRIEF SUMMARY

The following summary presents a simplified summary in order to provide a basic understanding of some aspects of the devices discussed herein. This summary is not an extensive overview of the devices discussed herein. It is not intended to identify critical elements or to delineate the scope of such devices. Its sole purpose is to present some concepts in a simplified form as a prelude to the more detailed description that is presented later.

In accordance with one aspect, provided is a cooking apparatus that includes a housing forming an oven cavity within the housing. A door is attached to the housing for selectively opening and closing the oven cavity. The door includes an outer surface and an inner surface. The inner surface includes a vent in fluid communication with an air channel within the door. A movable blocking element selectively opens and closes the vent. The movable blocking element is biased against the vent when the door is open, thereby closing the vent when the door is open. The movable blocking element is configured to translate linearly within the door, toward the vent and away from the outer surface of the door to close the vent, and toward the outer surface of the door and away from the vent to open the vent.

In accordance with another aspect, provided is a cooking apparatus that includes a housing forming an oven cavity within the housing. A door is attached to the housing for selectively opening and closing the oven cavity. The door includes an outer surface and an inner surface. The inner surface includes a vent in fluid communication with an air channel within the door. A movable blocking element selectively opens and closes the vent. The movable blocking element is biased against the vent when the door is open, thereby closing the vent when the door is open. A bearing surface is located within the door and extends toward the outer surface of the door and toward the inner surface of the door. The movable blocking element is configured to translate within the door on the bearing surface.

In accordance with another aspect, provided is a cooking apparatus that includes a housing forming an oven cavity within the housing. A door is attached to the housing for selectively opening and closing the oven cavity. The door comprises an outer surface and an inner surface. The inner surface includes a vent in fluid communication with an air channel within the door. A movable blocking element selectively opens and closes the vent. The movable blocking element is biased against the vent when the door is open, thereby closing the vent when the door is open. A blocking element bracket is located within the door and comprises an upper bearing surface and a lower bearing surface. A bias spring biases the movable blocking element. The movable blocking element is attached to the blocking element bracket through the bias spring. A movable pin extends from the movable blocking element and through the inner surface of the door. The movable pin and the bias spring are coaxially aligned. The movable blocking element is configured to translate linearly within the door, toward the vent and away from the outer surface of the door to close the vent, and toward the outer surface of the door and away from the vent to open the vent. The movable blocking element comprises an upper support arm that slides along the upper bearing surface, and a lower support arm that slides along the lower bearing surface, as the movable blocking element translates linearly within the door. The movable blocking element further comprises a first alignment arm extending from the movable blocking element past the lower bearing surface, and a second alignment arm extending from the movable blocking element past the upper bearing surface. The first and second alignment arms limit movement of the moveable blocking element in a side-to-side direction within the door, the side-to-side direction being substantially perpendicular to a linear translation direction of the movable blocking element toward the vent and away from the outer surface of the door. The movable pin contacts the housing of the oven when the door is in a closed position and the movable pin drives the movable blocking element away from the vent when the door is in the closed position.

DETAILED DESCRIPTION

Figure 1:
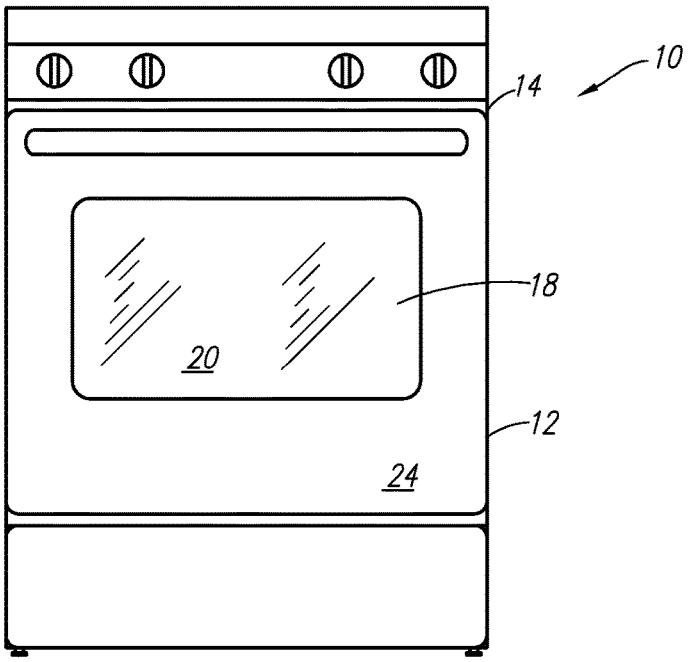
FIG. 1 is a front elevation view of a cooking appliance.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Figure 2:
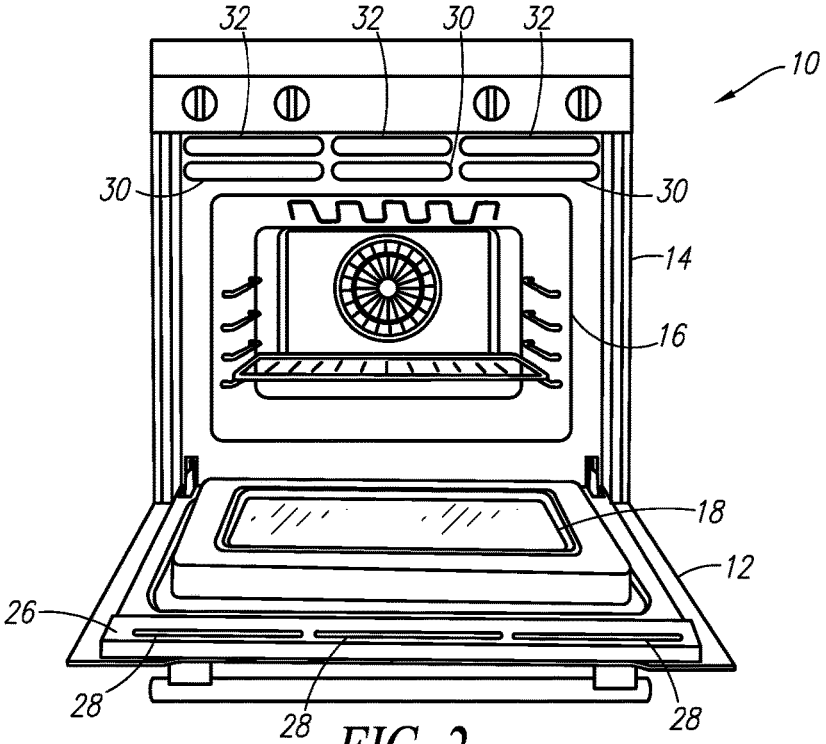
FIG. 2 is a front view of the cooking appliance.

FIG. 1 shows a cooking apparatus or appliance, such as a wall oven or freestanding range (hereinafter "oven") 10. The oven 10 has a door 12 attached to the housing 14 of the oven. The door 12 is typically hinged at its lower edge to open forward, but it could be hinged at one of its vertical edges. The door 12 alternatively closes and opens to provide access to an oven cavity 16 (see FIG. 2).

The door 12 can include a window 18 for allowing the oven cavity 16 to be viewed when the door 12 is in the closed position. The window can have an outer pane 20, an inner pane 22, and additional panes if desired.

The door 12 has an outer surface 24 that faces forward when the door is in the closed position (and faces generally downward when the door is fully open). The door 12 further has an inner surface 26 that closes the oven cavity 16 when the door is in the closed position. The inner surface 26 faces generally upward when the door 12 is fully open.

The inner surface 26 of the door 12 can have one or more vents 28. It can be seen in FIG. 2 that the inner surface 26 of the door has a plurality of vents 28. The vents 28 allow air to flow through the door to cool the outer surface 24 of the door (e.g., the outer pane 20) when the oven operates. Air can be drawn into the door 12 through additional vents along the lower edge of the door. The air can flow upward through the door 12, between the outer 24 and inner 26 surfaces of the door (e.g., between the outer 20 and inner 22 panes) and be discharged from the door through the vents 28. The air passes from the vents 28 in the inner surface of the door 12 into corresponding vents 30 in the oven housing 14. The air can flow through the housing 14 via appropriate ducting to cool the interior of the oven 10, and the air can be discharged through further vents 32 in the housing. The air can be pulled through the door 12 and oven housing 14 by one or more fans within the door 12 and/or oven housing 14.

Figure 3:
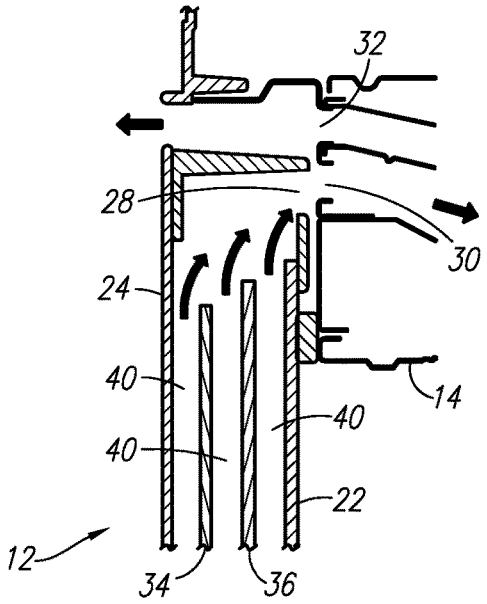
FIG. 3 is a partial side section view of the cooking appliance.

A schematic example of an airflow path through the door 12 and oven housing 14 is shown in FIG. 3. Air can be drawn into the door by a fan in the oven housing. The air enters the door 12 through vents located along the lower edge of the door or elsewhere on the door. The air can flow upward within the door through air channels 40 within the door. The air channels 40 can be formed by the outer surface 24 and/or outer pane of the door 12, the inner surface and/or inner pane 22 of the door, and one or more additional interior panes 34, 36. The vents 28 on the inner surface of the door 12 and the vents on the lower edge of the door are in fluid communication with the air channel(s) 40. The air flowing through the door 12 flows through the air channel(s) 40 and passes through the vents 28 in the inner surface of the door 12, and through the corresponding vents 30 in the oven housing 14. The air is blown by the fan out of the further vents 32 in the housing 14. The airflow through the door 12 can cool the outer surface of the door and also cool components within the oven housing 14, such as oven control system electronics for example. The air can then be recirculated into a kitchen in which the oven 10 is located.

As discussed above, one problem associated with the vents 28 in the inner surface of the door 12 is that food or liquids can enter the interior of the oven door through the vents, due to an accidental spill for example. Such food or liquids may stain the panes of the oven door 12 and/or cause unpleasant odors during cooking, and it can be difficult to clean food or liquid from the interior of the oven door 12.

Figure 4:
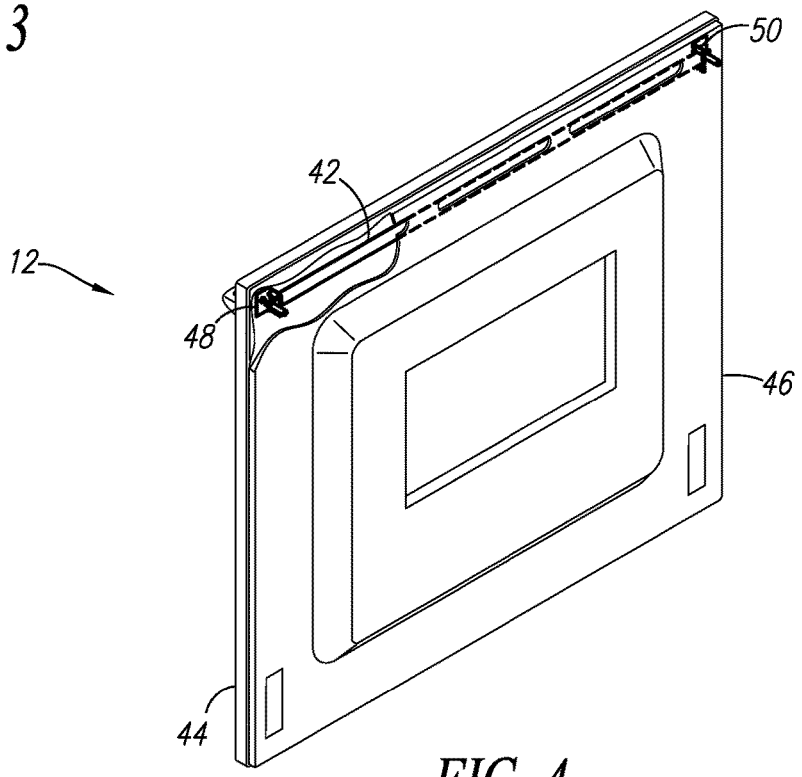
FIG. 4 is a perspective view of a door of the cooking appliance.

Turning to FIG. 4, the oven door 12 includes a movable blocking element 42 that is located within the door, between the inner surface and the outer surface of the door. The movable blocking element 42 is configured to automatically close the vents 28 (FIG. 2) when the door 12 is open, to prevent or substantially inhibit the ability of solids or liquids from entering the interior of the door through the vents when the door is open. The movable blocking element 42 is further configured to automatically open the vents 28 (FIG. 2) when the door 12 is closed, thereby allowing air to flow through the door and through the open vents 28 and into the oven housing, via the corresponding vents 30 (FIG. 2) in the housing. Thus, the movable blocking element 42 is capable of selectively opening and closing the vents 28, depending on the position of the door 12.

It can be seen in FIG. 4 that the movable blocking element 42 spans substantially the entire width of the door 12, from a first lateral side 44 of the door (e.g., the right-hand side of the door) to a second lateral side 46 of the door (e.g., the left hand side of the door). Thus, the movable blocking element 42 can open and close the various discharge vents 28 (FIG. 2) in the door simultaneously.

With reference to FIGS. 1-7, the movable blocking element 42 is mounted within the door by a first blocking element bracket 48 and a second blocking element bracket 50 located within the door. The blocking element brackets 48, 50 and the movable blocking element 42 are all located in the interior of the door 12, between the inner and outer surfaces of the door. The first blocking element bracket 48 is located adjacent the first lateral side 44 of the door and the second blocking element bracket 50 is located adjacent the second lateral side 46 of the door.

The blocking element brackets 48, 50 can have an "L" or "C" shape, with a first leg 52 of the bracket attached to the door and a second leg 54 of the bracket having an opening or slot 56 for receiving one end of the movable blocking element 42. In an embodiment, the first leg 52 and the second leg 54 of the bracket are substantially perpendicular to each other.

The movable blocking element 42 can translate linearly within the door 12 and within the slot 56 in blocking element brackets 48, 50. The movable blocking element moves toward the vents 28 and away from the outer surface 24 of the door to close the vents, and toward the outer surface of the door and away from the vents to open the vents. The movable blocking element's direction of motion is shown by arrow 58 in the figures. The movable blocking element's direction of motion can be considered to be generally perpendicular to parallel planes corresponding to the inner and outer surfaces of the door 12. The movable blocking element 42 can include embossed or stamped projections that are aligned with the vents 28 and plug the vents when the door 12 is open.

The movable blocking element 42 is attached to the blocking element brackets 48, 50 through respective bias springs 60. The bias springs 60 push or bias the movable blocking element 42 toward the vents 28. The movable blocking element 42 can move within the slot 56 in the brackets 48, 50, and the bias springs 60 resist such movement, pushing the movable blocking element toward the vents 28. When the door 12 is open, the movable blocking element 42 is biased against the vents 28 to thereby close the vents. However, when the door 12 is closed, the bias springs 60 are compressed and the movable blocking element 42 is driven away from the vents 28 to open the vents 28.

To compress the bias springs 60 and push the movable blocking element 42 away from the vents, movable pins 64, 66 are provided that move with the movable blocking element. The movable pins 64, 66 can be attached to the movable blocking element 42 through an interference fit or through appropriate mounting hardware, or the movable pins 64, 66 can be integrally formed with the movable blocking element. The movable pins 64, 66 can extend from the movable blocking element 42 through the inner surface 26 of the door 12, so as to extend from the inner surface of the door. Thus, the movable pins 64, 66 will project outward from the inner surface 26 of the door 12 when the door is open.

Figure 5:
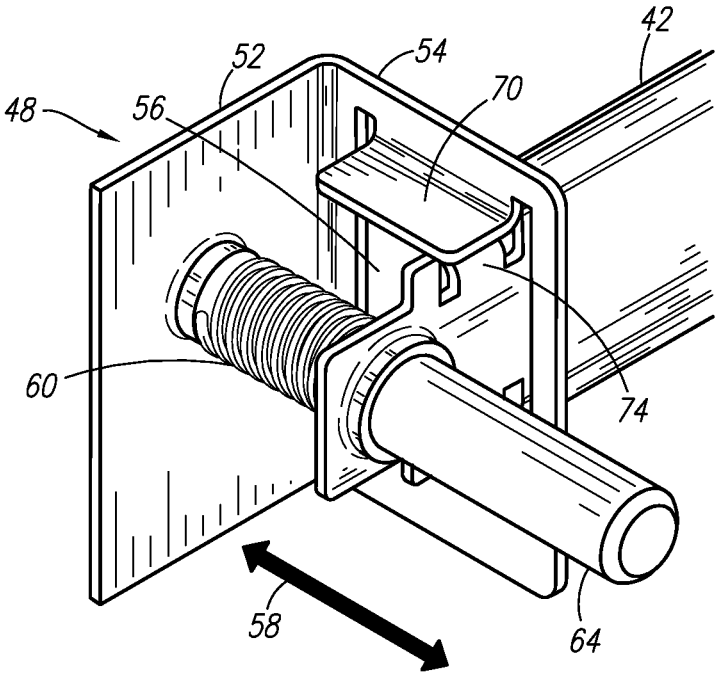
FIG. 5 is a perspective view of a portion of the cooking appliance.
Figure 6:
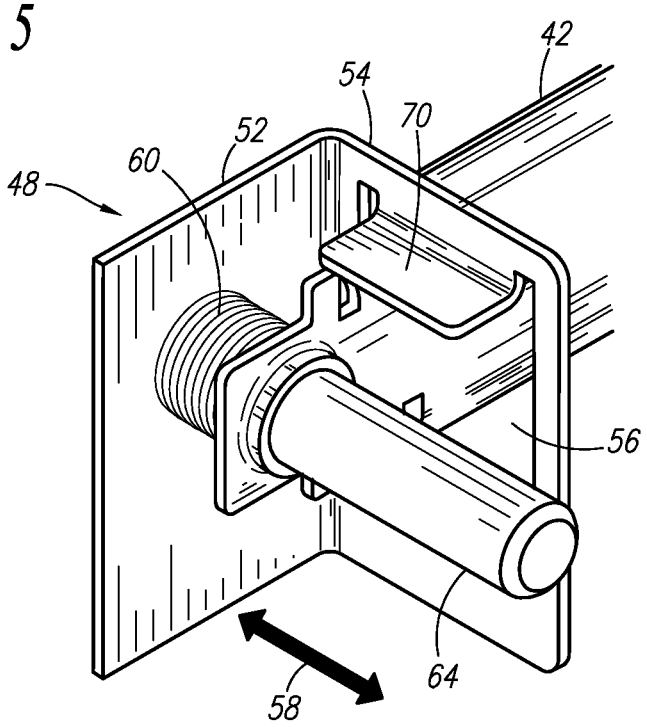
FIG. 6 is a perspective view of a portion of the cooking appliance.
Figure 7:
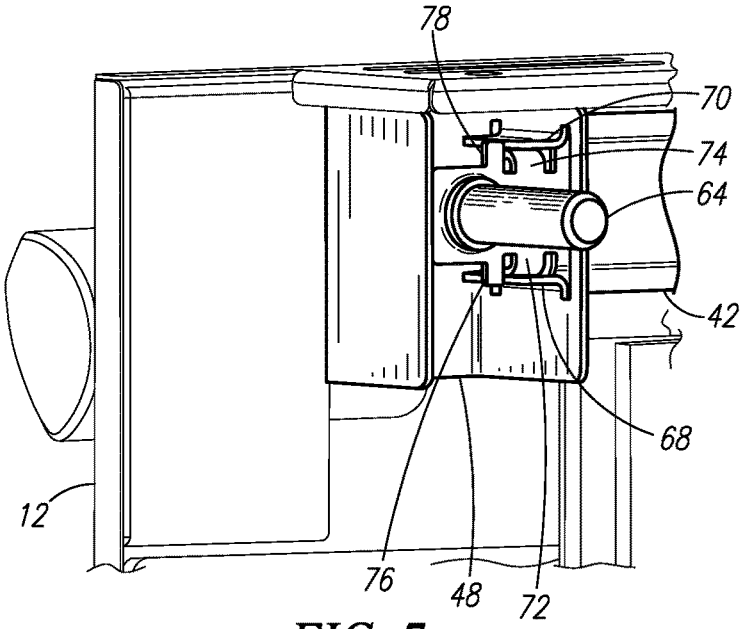
FIG. 7 is a perspective view of a portion of the cooking appliance.

To automatically open the vents 28 when the door 12 is closed, the movable pins 64, 66 are configured to contact the housing 14 of the oven and compress the bias springs 60 driving the movable blocking element 42 away from the vents 28. The compression of the bias spring 60 and the movement of the movable blocking element 42 within the slot 56 in the blocking element bracket 48 can be seen in FIGS. 5 and 6. In FIG. 5, the bias spring 60 is not compressed, and the movable blocking element 42 is pushed toward the rear of the slot 56 by the bias spring. In FIG. 6, the bias spring is compressed and the movable blocking element 42 is pushed toward the front of the slot 56 by the movable pin 64.

In certain embodiments, the bias spring 60 and the movable pin 64 can be coaxially aligned. This can allow the movable pin 64 to compress the bias spring 60 while applying a minimum amount of torque to the movable blocking element 42.

Projecting inward toward the interior of each blocking element bracket 48, 50 are a lower bearing tab 68 and an upper bearing tab 70. The movable blocking element 42 includes a lower support arm 72 that sits on the lower bearing tab 68, and an upper support arm 74 that engages the upper bearing tab. The lower and upper support arms 72, 74 extend away from the movable blocking element 42 in the direction of movement of the movable blocking element. The weight of the movable blocking element 42 is supported by the blocking element brackets 48, 50 by the lower bearing tabs 68. As the movable blocking element 42 moves within the slot 56, the support arms 72, 74 of the movable blocking element slide along respective lower and upper bearing surfaces on the bearing tabs 68, 70. That is, the lower support arm 72 slides along the upwardly-facing lower bearing surface on the lower bearing tab 68, and the upper support arm 74 slides along the downwardly-facing upper bearing surface on the upper bearing tab 70. It can be seen that the bearing surfaces of the bearing tabs 68, 70 extend in the direction of movement of the movable blocking element 42, i.e., in the direction shown by arrow 58, toward the inner 26 and outer 24 surfaces of the door 12.

To limit the side-to-side movement of the moveable blocking element 42 in a direction generally perpendicular to the direction shown by arrow 58 (e.g., in a direction from the first lateral side 44 of the door 12 toward the second lateral side 46 of the door), the movable blocking element 42 includes a lower alignment arm 76 and an upper alignment arm 78. The lower alignment arm 76 projects downward from the movable blocking element 42 past the lower bearing surface of the lower bearing tab 68. The upper alignment arm 78 projects upward from the movable blocking element 42 past the upper bearing surface of the upper bearing tab 70. The lower and upper alignment arms 76, 78 are provided at both lateral ends of the movable blocking element 42. Thus, side-to-side movement of the movable blocking element 42 will be blocked by the lower and upper alignment arms 76, 78 respectively contacting the lower and upper bearing tabs 68, 70. The lower and upper bearing tabs 68, 70 of each blocking element bracket 48, 50 will limit the motion of the movable blocking element 42 in a direction perpendicular to the primary linear translation direction of the movable blocking element within the door 12, which is toward the vents 28 and away from the outer surface 24 of the door 12 and vice versa.

Figure 8:
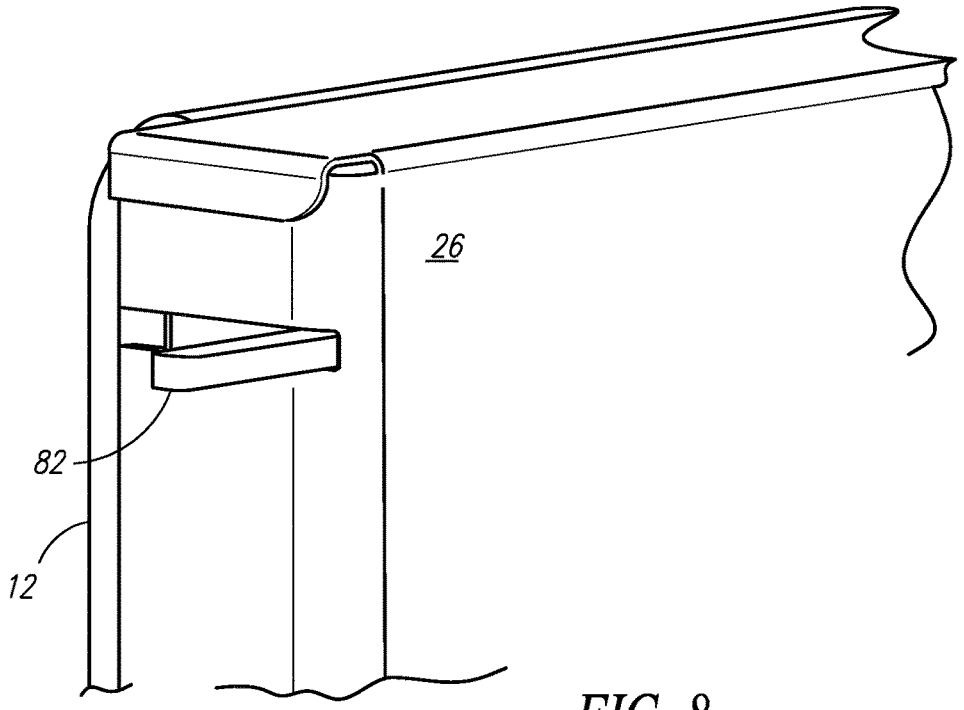
FIG. 8 is a perspective view of a portion of a cooking appliance.
Figure 9:
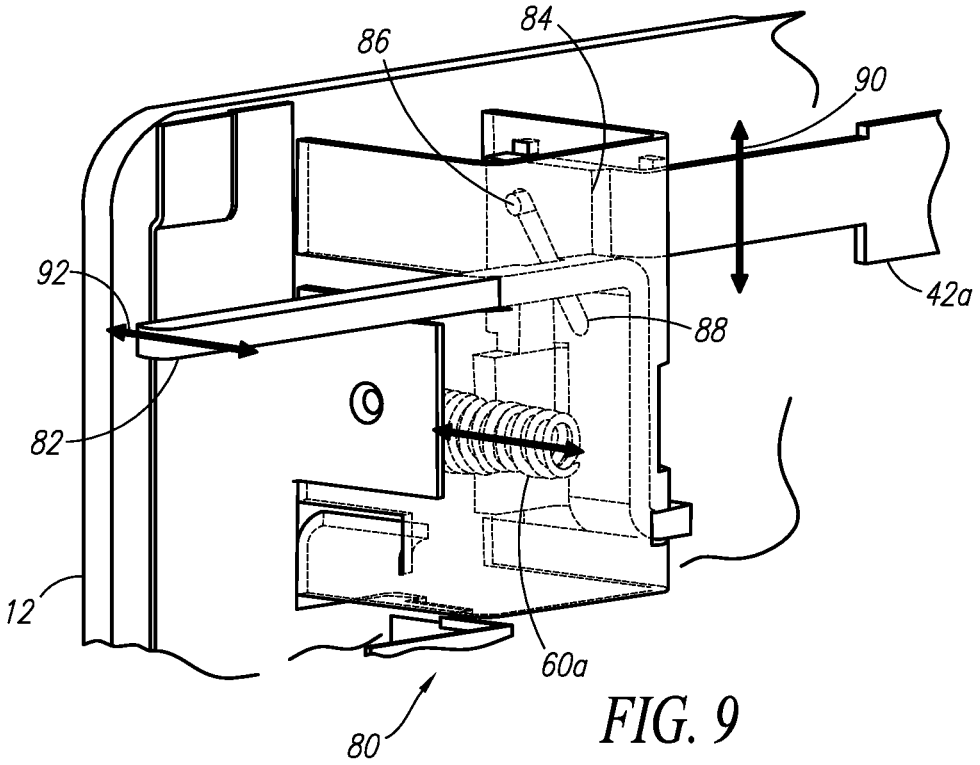
FIG. 9 is another perspective view of the portion of the cooking appliance of FIG. 8.

FIGS. 8 and 9 show another embodiment a movable blocking element 42*a* actuation system 80. An exterior perspective view of the door is provided in FIG. 8, and a partial interior view is provided in FIG. 9. Rather than having movable pins, the actuation system 80 includes a movable arm 82 that projects outward from a lateral side of the oven door 12. The movable arm 82 is biased toward the inner surface 26 of the door 12 by a bias spring 60*a*. When the oven door is closed, the movable arm 82 contacts the oven housing or an element attached to the oven housing and is pushed forward toward the outer surface of the door 12, compressing the bias spring 60*a*. As the movable arm 82 is pushed forward, a slotted member 84 attached to the movable arm 82 is also driven forward. A pin 86 attached to the movable blocking element 42*a* rides in the slot 88 of the slotted member 84. As the slotted member 84 is driven forward, the pin 86 and movable blocking member 42*a* are driven downward along the direction of arrow 90, thereby opening the vents. When the door 12 is opened, the bias spring 60*a* pushes the movable arm 82 toward the inner surface 26 of the door along the direction of arrow 92, which automatically drives the pin 86 and movable blocking member 42*a* upward, thus blocking the vents in the door. The door 12 can include a single actuation system 80 located at a lateral side of the door, or actuation systems located at both lateral sides of the door.

Figure 10:
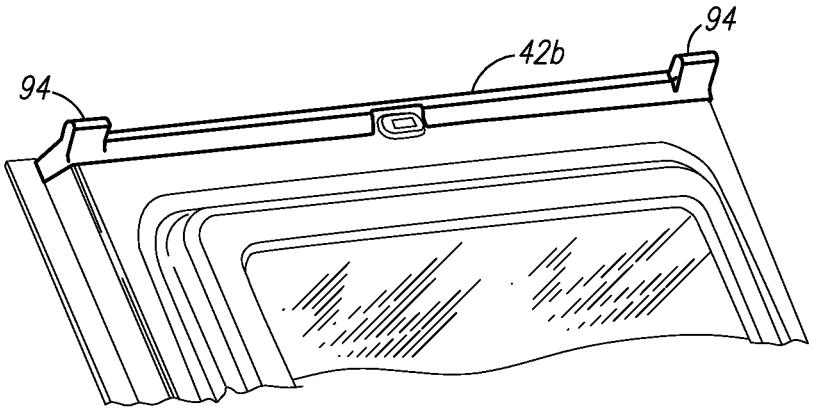
FIG. 10 is a partial perspective view of a portion of a door of a cooking appliance.

FIG. 10 shows a further embodiment of a movable blocking element 42*b*. The movable blocking element 42*b* is in the form of a cover arranged on an outside top portion of the door 12. The cover is hinged and can pivot upward to expose the vents. The cover is biased downward to cover the vents when the door 12 is open. The cover can be biased downward by a spring, for example. When the door 12 is closed, cam elements 94 on the cover contact the housing of the oven, which forces the cover to pivot upward, exposing the vents.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooking apparatus, comprising:

a housing forming an oven cavity within the housing;

a door attached to the housing for selectively opening and closing the oven cavity, the door comprising an outer surface and an inner surface, wherein the inner surface includes a vent in fluid communication with an air channel within the door;

a movable blocking element for selectively opening and closing the vent, wherein the movable blocking element is biased against the vent when the door is open, thereby closing the vent when the door is open; and a blocking element bracket located within the door, said blocking element bracket comprising a first leg attached to the door and a second leg having an opening or slot for receiving one end of the movable blocking element, wherein the first leg and the second leg are substantially perpendicular to each other, wherein the movable blocking element is configured to translate predominantly linearly within the door, toward the vent and away from the outer surface of the door to close the vent, and toward the outer surface of the door and away from the vent to open the vent.

2. The cooking apparatus of claim 1, wherein the blocking element bracket comprises a bearing surface, and wherein the movable blocking element comprises a support arm that slides along the bearing surface as the movable blocking element translates linearly within the door along the bearing surface.

3. The cooking apparatus of claim 2, wherein:

the bearing surface is a lower bearing surface, the blocking element bracket further comprises an upper bearing surface, and the movable blocking element further comprises a second support arm that slides along the upper bearing surface.

4. The cooking apparatus of claim 2, wherein the movable blocking element further comprises an alignment arm extending downward from the movable blocking element past the bearing surface, wherein the alignment arm limits movement of the moveable blocking element in a side-to-side direction within the door, the side-to-side direction being perpendicular to a linear translation direction of the movable blocking element toward the vent and away from the outer surface of the door.

5. The cooking apparatus of claim 1, further comprising:

a bias spring for biasing the movable blocking element, wherein the movable blocking element is attached to the first leg of the blocking element bracket through the bias spring such that the movable blocking element translates linearly within the door and with respect to the blocking element bracket.

6. The cooking apparatus of claim 5, wherein the bias spring is a first bias spring, and the blocking element bracket is a first blocking element bracket and is located adjacent a first lateral side of the door, the cooking apparatus further comprising a second bias spring and a second blocking element bracket located adjacent a second lateral side of the door, and the movable blocking element is attached to the second blocking element bracket through the second bias spring such that the movable blocking element translates linearly within the door with respect to the second blocking element bracket.

7. The cooking apparatus of claim 1, wherein the door comprises a movable pin extending from the inner surface of the door, wherein the movable pin contacts the housing of the oven when the door is in a closed position and the movable pin drives the movable blocking element away from the vent when the door is in the closed position.

8. The cooking apparatus of claim 7, further comprising a bias spring for biasing the movable blocking element, wherein the movable blocking element is attached to the blocking element bracket through the bias spring such that the movable blocking element translates linearly within the door and with respect to the blocking element bracket, and wherein the bias spring and the movable pin are coaxially aligned.

9. A cooking apparatus, comprising:

a housing forming an oven cavity within the housing;

a door attached to the housing for selectively opening and closing the oven cavity, the door comprising an outer surface and an inner surface, wherein the inner surface includes a vent in fluid communication with an air channel within the door;

a movable blocking element for selectively opening and closing the vent, wherein the movable blocking element is biased against the vent when the door is open, thereby closing the vent when the door is open;

a blocking element bracket located within the door, said blocking element bracket comprising a first leg attached to the door and a second leg having an opening or slot for receiving one end of the movable blocking element, wherein the first leg and the second leg are substantially perpendicular to each other; and a bearing surface located within the door and extending toward the outer surface of the door and toward the inner surface of the door, wherein the movable blocking element is configured to translate within the door on the bearing surface.

10. The cooking apparatus of claim 9, wherein the blocking element bracket comprises the bearing surface and a support arm that slides along the bearing surface as the movable blocking element translates linearly within the door on the bearing surface.

11. The cooking apparatus of claim 9, wherein:

the bearing surface is a lower bearing surface, the blocking element bracket further comprises an upper bearing surface, and the movable blocking element further comprises a second support arm that slides along the upper bearing surface.

12. The cooking apparatus of claim 11, wherein the movable blocking element further comprises an alignment arm extending downward from the movable blocking element past the bearing surface, wherein the alignment arm limits movement of the moveable blocking element in a side-to-side direction within the door, the side-to-side direction being perpendicular to a linear translation direction of the movable blocking element toward the vent and away from the outer surface of the door.

13. The cooking apparatus of claim 9, further comprising:

a bias spring for biasing the movable blocking element, wherein the movable blocking element is attached to the blocking element bracket through the bias spring such that the movable blocking element translates linearly within the door, and with respect to the blocking element bracket, on the bearing surface, wherein the blocking element bracket comprises the bearing surface.

14. The cooking apparatus of claim 13, wherein the bias spring is a first bias spring, and the blocking element bracket is a first blocking element bracket and is located adjacent a first lateral side of the door, the cooking apparatus further comprising a second bias spring and a second blocking element bracket located adjacent a second lateral side of the door, and the movable blocking element is attached to the second blocking element bracket through the second bias spring such that the movable blocking element translates linearly within the door with respect to the second blocking element bracket.

15. The cooking apparatus of claim 9, wherein the door comprises a movable pin extending from the inner surface of the door, wherein the movable pin contacts the housing of the oven when the door is in a closed position and the movable pin drives the movable blocking element away from the vent when the door is in the closed position.

16. The cooking apparatus of claim 15, further comprising a blocking element bracket located within the door and comprising the bearing surface; and a bias spring for biasing the movable blocking element, wherein the movable blocking element is attached to the blocking element bracket through the bias spring such that the movable blocking element translates linearly within the door and with respect to the blocking element bracket, and wherein the bias spring and the movable pin are coaxially aligned.

17. A cooking apparatus, comprising:

a housing forming an oven cavity within the housing;

a door attached to the housing for selectively opening and closing the oven cavity, the door comprising an outer surface and an inner surface, wherein the inner surface includes a vent in fluid communication with an air channel within the door; and a movable blocking element for selectively opening and closing the vent, wherein the movable blocking element is biased against the vent when the door is open, thereby closing the vent when the door is open, a blocking element bracket located within the door and comprising an upper bearing surface and a lower bearing surface;

a bias spring for biasing the movable blocking element, wherein the movable blocking element is attached to the blocking element bracket through the bias spring; and a movable pin extending from the movable blocking element and through the inner surface of the door, wherein the movable pin and the bias spring are coaxially aligned, wherein the movable blocking element is configured to translate linearly within the door, toward the vent and away from the outer surface of the door to close the vent, and toward the outer surface of the door and away from the vent to open the vent, wherein the movable blocking element comprises an upper support arm that slides along the upper bearing surface, and a lower support arm that slides along the lower bearing surface, as the movable blocking element translates linearly within the door, and the movable blocking element further comprises a first alignment arm extending from the movable blocking element past the lower bearing surface, and a second alignment arm extending from the movable blocking element past the upper bearing surface, wherein the first and second alignment arms limit movement of the moveable blocking element in a side-to-side direction within the door, the side-to-side direction being substantially perpendicular to a linear translation direction of the movable blocking element toward the vent and away from the outer surface of the door, wherein the movable pin contacts the housing of the oven when the door is in a closed position and the movable pin drives the movable blocking element away from the vent when the door is in the closed position.

18. The cooking apparatus of claim 17, wherein the blocking element bracket is located adjacent a first lateral side of the door, the cooking apparatus further comprising:

a second blocking element bracket located adjacent a second lateral side of the door;

a second bias spring for biasing the movable blocking element, wherein the movable blocking element is attached to the second blocking element bracket through the second bias spring; and a second movable pin extending from the movable blocking element and through the inner surface of the door, wherein the second movable pin and the second bias spring are coaxially aligned.

* * * * *